United States Patent [19]

Sakamoto

[11] Patent Number: 4,918,417

[45] Date of Patent: Apr. 17, 1990

[54] INDUCTOR HAVING PARALLEL LINE ELECTRODES

[75] Inventor: Yukio Sakamoto, Nagaokakyo, Japan

[73] Assignee: Murata Manufacturing Co., Ltd., Japan

[21] Appl. No.: 362,065

[22] Filed: Jun. 6, 1989

[30] Foreign Application Priority Data

Jun. 9, 1988 [JP] Japan ..... 63-76547[U]

[51] Int. Cl.[4] ..... H01F 17/00; H01F 27/30

[52] U.S. Cl. ..... 336/83; 336/192; 336/200; 336/232; 336/233

[58] Field of Search ..... 336/83, 200, 232, 225, 336/223, 233, 212, 192

[56] References Cited

U.S. PATENT DOCUMENTS 3,247,573 4/1966 Noack ..... 336/220 X 3,848,209 11/1974 Lee et al. ..... 336/200 X 3,932,827 1/1976 Buhner ..... 336/200 X 4,383,235 5/1983 Layton et al. ..... 336/200

*Primary Examiner*—Thomas J. Kozma

*Attorney, Agent, or Firm*—Ostrolenk, Faber, Gerb & Soffen

[57] ABSTRACT

A plurality of inductor elements are arranged side by side in a sintered body obtained by stacking a plurality of ceramic green sheets to cofire the same. Each of the inductor elements comprises at least one line electrode extending in such a direction as to connect first and second side surfaces of the sintered body and outer electrodes electrically connected to both ends of the line electrode. The line electrodes constituting the adjacent inductor elements are formed so as not be positioned in the same plane, that is, in different positions of the heights.

7 Claims, 3 Drawing Sheets

INDUCTOR HAVING PARALLEL LINE ELECTRODES

BACKGROUND OF THE INVENTION

1. Field of the Invention

The present invention relates generally to an inductor constructed by using a monolithic sintered body obtained by stacking a plurality of ceramic green sheets to cofire the same, and more particularly, to an inductor in which a plurality of inductor elements are formed in a sintered body.

2. Description of the Prior Art

Conventionally, an inductor shown in a perspective view of FIG. 1 has been known. In an inductor 1, a plurality of inductor elements are formed in a sintered body 2 obtained by stacking a plurality of ceramic green sheets to cofire the same. More specifically, a plurality of line electrodes 3*a*, 3*b*, 4*a*, 4*b*, 5*a*, 5*b*, 6*a* and 6*b* are arranged so as to extend between side surfaces 2*a* and 2*b* of the sintered body 2 which are opposed to each other.

Both ends of the line electrodes 3*a* and 3*b* are electrically connected to outer electrodes 7*a* and 7*b* (represented by imaginary lines) provided on side surfaces 2*a* and 2*b* of the sintered body 2, respectively. Similarly, the remaining line electrodes 4*a* and 4*b* to 6*a* and 6*b* are electrically connected to outer electrodes 8*a* and 8*b* to 10*a* and 10*b* provided on the side surfaces 2*a* and 2*b* of the sintered body 2, respectively. Thus, in the sintered body 2, four inductor elements are respectively formed between the outer electrodes 7*a* to 10*a* and the outer electrodes 7*b* to 10*b*.

In obtaining the above described sintered body 2, a plurality of ceramic green sheets 11 to 16 mainly composed of, for example, magnetic materials shown in FIG. 2 are used. The upper surfaces of the ceramic green sheets 13 and 14 out of the ceramic green sheets 11 to 16 are respectively coated with conductive pastes 3*b* to 6*b* and 3*a* to 6*a* with predetermined spacing. The conductive pasts 3*a* to 6*b*, which constitute the above described line electrodes 3*a* to 6*b* after cofiring, have the same reference numerals as those of the line electrodes 3*a* to 6*b*.

The sintered body 2 is obtained by stacking the ceramic green sheets 11 to 16 in the direction shown in FIG. 2 to cofire the same.

Meanwhile, in the above described construction, the conductive pastes 3*a* to 6*a* or 3*b* to 6*b* applied to the upper surface of each of the ceramic green sheets 13 and 14 are arranged on the same plane in a state close to each other with relatively short spacing. Thus, in the obtained sintered body 2, magnetic induction is liable to occur between the adjacent line electrodes, for example, between the line electrodes adjacent to each other in the horizontal direction such as the line electrodes 3*a* and 4*a*. More specifically, the inductor thus constructed has the disadvantage in that mutual interference of signals, i.e., crosstalk between the adjacent line electrodes is liable to be increased.

SUMMARY OF THE INVENTION

Accordingly, an object of the present invention is to provide an inductor having a structure in which the number of times of occurrence of crosstalk can be reduced.

In accordance with a wide aspect, the present invention provides an inductor comprising a sintered body obtained by stacking a plurality of ceramic green sheets to cofire the same, a plurality of line electrodes arranged so as to extend between first and second side surfaces of the sintered body and arranged side by side in a direction perpendicularly intersecting such a direction as to connect the first and second side surfaces thereof in this sintered body, and a plurality of outer electrodes respectively provided on the first and second side surfaces of the sintered body so as to be electrically connected to both ends of the line electrodes, a plurality of inductor elements formed between the plurality of outer electrodes provided on the first side surface of the sintered body and the plurality of outer electrodes provided on the second side surface thereof being arranged side by side in the direction perpendicularly intersecting the direction to connect the first and second side surfaces, characterized in that the line electrodes constituting the adjacent inductor elements are formed of line electrode materials applied to the different ceramic green sheets such that the line electrodes constituting the inductor elements adjacent to each other in the direction perpendicularly intersecting the direction to connect the first and second side surfaces of the sintered body are not positioned in the same plane.

In accordance with a particular aspect of the present invention, a ceramic green sheet having line electrode materials forming line electrodes constituting one of adjacent inductor elements applied thereto and a ceramic green sheet having line electrode materials forming line electrodes constituting the other inductor applied thereto are stacked with ceramic green sheets having no line electrode materials applied thereto being interposed therebetween, so that respective positions of the heights of the line electrodes constituting the adjacent inductor elements are made different from each other.

Furthermore, at least one of the plurality of inductor elements may be adapted to have a plurality of line electrodes overlapped with each other through ceramics layers in the direction of the thickness of the sintered body.

In a particular example of the present invention, line electrodes constituting a plurality of inductor elements are alternately formed in first and second positions of the heights of a sintered body in a direction perpendicularly intersecting such a direction as to connect first and second side surfaces of the sintered body. The inductor thus constructed can be achieved by stacking one ceramic green sheet having a plurality of line electrodes formed thereon with predetermined spacing and the other ceramic green sheet having a plurality of line electrodes formed thereon with the same spacing as the above described predetermined spacing such that each of line electrode materials on the one ceramic green sheet is positioned in the center of line electrode materials on the other ceramic green sheet.

According to the present invention, since the line electrodes constituting the inductor elements adjacent to each other in the direction perpendicularly intersecting the direction to connect the first and second side surfaces of the sintered body are adapted not to be positioned in the same plane, the distance between the line electrodes constituting the adjacent inductor elements becomes longer than that in a case in which they are arranged in the same plane. Thus, the number of times of occurrence of crosstalk can be effectively reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
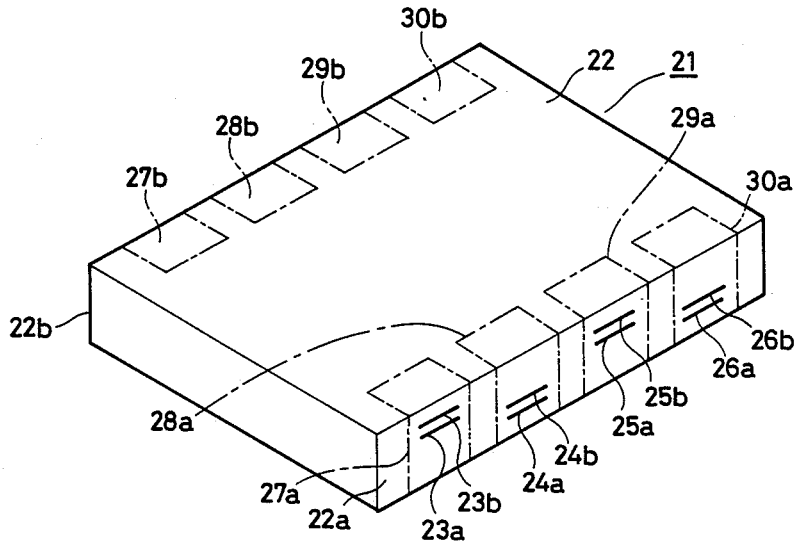
FIG. 3 is a perspective view showing an inductor according to an embodiment of the present invention.

FIG. 3 is a perspective view showing an inductor according to an embodiment of the present invention. An inductor 21 is constructed by using a sintered body 22 formed of a magnetic material. This sintered body 22 is formed by stacking a plurality of ceramic green sheets, applying pressure in the direction of the thickness and then, cofiring the same, as described below.

A plurality of line electrodes 23*a* and 23*b* to 26*a* and 26*b* are arranged so as to extend between a first side surface 22*a* and a second side surface 22*b* of the sintered body 22 in a relation opposed to each other. The line electrodes 23*a* and 23*b* are electrically connected to an outer electrode 27*a* provided on the first side surface 22*a* at one end and an outer electrode 27*b* provided on the second side surface 22*b* at the other end. It should be noted that the outer electrodes are represented by imaginary lines in order to clearly show the positions of the line electrodes exposed on the side surfaces of the sintered body. As is obvious from the foregoing, a single inductor element is formed between the outer electrodes 27*a* and 27*b*.

Similarly, in portions where the remaining line electrodes 24*a* and 24*b* to 26*a* and 26*b* are formed, inductor elements are respectively formed between the outer electrodes 28*a* and 28*b*, 29*a* and 29*b* and 30*a* and 30*b*. Thus, constructed is an inductor in which four inductor elements are arranged side by side in a direction perpendicularly intersecting such a direction as to connect the first and second side surfaces 22*a* and 22*b*.

Figure 1:
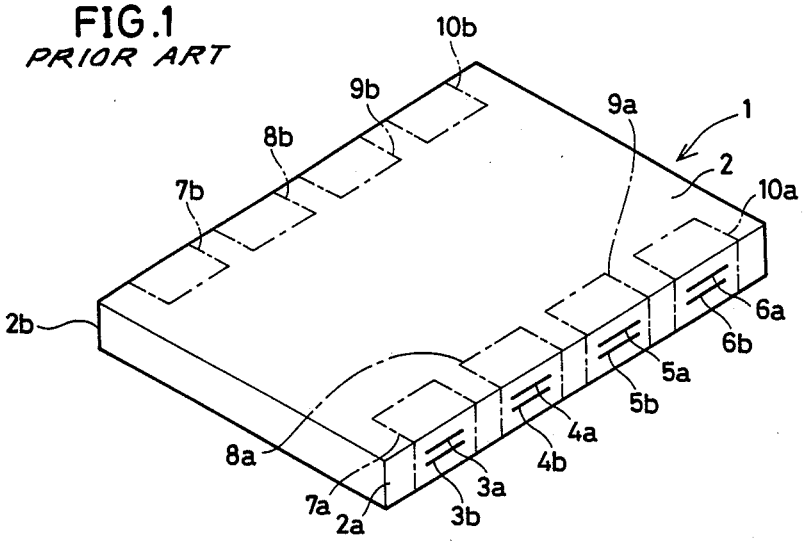
FIG.1 PRIOR ART
FIG. 1 is a typical perspective view showing a conventional inductor.
Figure 2:
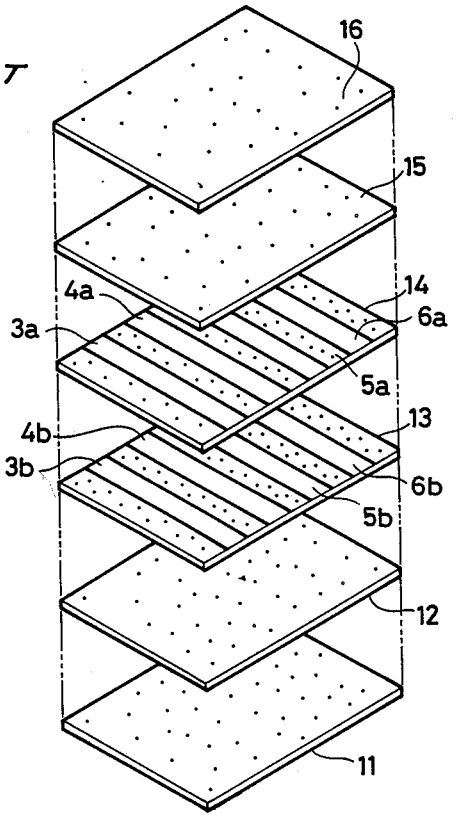
FIG.2 PRIOR ART
FIG. 2 is an exploded perspective view for explaining the shapes of ceramic green sheets used for obtaining the conventional inductor and line electrode materials applied thereto.

The inductor according to the present embodiment is characterized by the respective positions of the heights of the line electrodes 23*a* and 23*b* to 26*a* and 26*b* constituting the inductor elements. More specifically, the line electrodes constituting the inductor elements in a relation adjacent to each other in the direction perpendicularly intersecting the direction to connect to the first and second side surfaces 22*a* and 22*b* are formed so as not to be positioned in the same plane. For example, the line electrodes 23*a* and 23*b* constituting the inductor element are formed in the position of the heights different from that of the line electrodes 24*a* and 24*b* constituting the adjacent inductor element. Thus, as is obvious from comparison with the line electrodes 3*a*, 3*b*, 4*a* and 4*b* in the conventional inductor 1 shown in FIG. 1, the distance between the line electrodes constituting the adjacent inductor elements can be increased. Consequently, the number of times of occurrence of crosstalk between the adjacent inductor elements can be effectively reduced.

Figure 4:
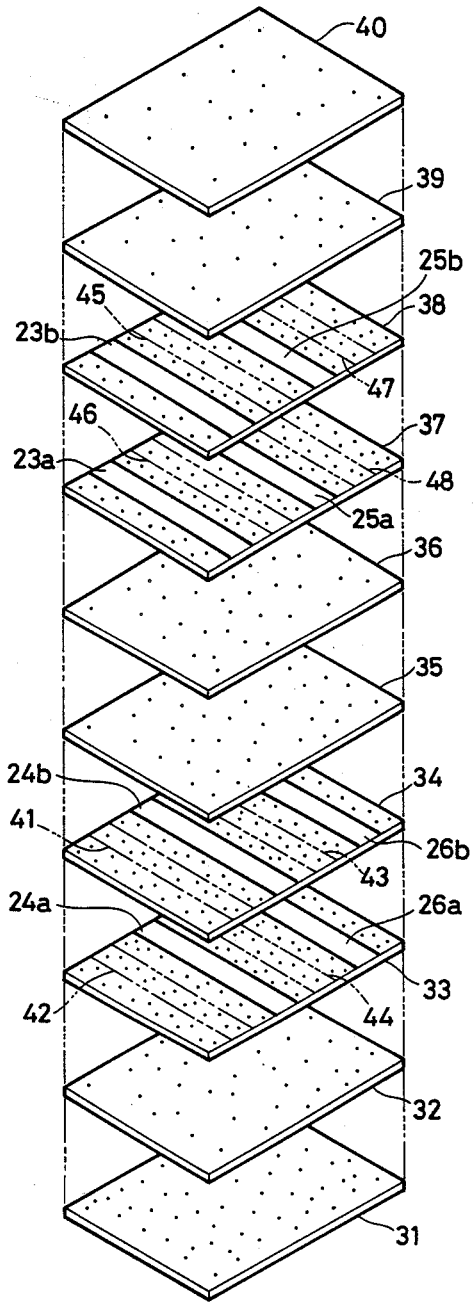
FIG. 4 is an exploded perspective view for explaining the shapes of a plurality of ceramic green sheets used for obtaining the inductor according to the embodiment shown in FIG. 3 and line electrode materials applied thereto.

The shape of each of the line electrodes 23*a* to 26*b* and the position where it is to be formed will be apparent by describing the process for manufacturing the above described sintered body 22 with reference to FIG. 4.

The sintered body 22 is obtained by stacking a plurality of ceramic green sheets 31 to 40 in the direction shown in FIG. 4, applying pressure in the direction of the thickness of the stack and then, cofiring the same. The ceramic green sheets 31 and 32 out of the ceramic green sheets 31 to 40 are stacked in the lower portion of the sintered body 22. Similarly, the ceramic green sheets 39 and 40 are stacked in the upper portion of the sintered body 22.

On the other hand, line electrode materials 23*a* to 26*b* are applied to the upper surfaces of the ceramic green sheets 33, 34, 37 and 38. The line electrode materials 23*a* to 26*b*, which are formed of conductive pastes mainly composed of, for example, silver, are printed on the upper surfaces of the ceramic green sheets having the line electrode materials applied thereto.

The positions where the line electrode materials 23*a* to 26*b* are to be formed will be described in more detail. According to the present embodiment, the line electrode materials 24*a*, 24*b*, 26*a* and 26*b* are applied to the ceramic green sheets 33 and 34 stacked in the relatively lower portion, to constitute the line electrodes 24*a*, 24*b*, 26*a* and 26*b* shown in FIG. 3.

More specifically, the line electrode materials 24*a* and 26*a* applied to the ceramic green sheet 33 and the line electrode material 24*b* and 26*b* applied to the ceramic green sheet 34 are formed in such a position as to be overlapped with each other when the ceramic green sheets 33 and 34 are stacked. Regions denoted by 41 and 42 and 43 and 44 (regions enclosed by imaginary lines) indicate positions respectively overlapped with the line electrode materials 23*a* and 23*b* and 25*a* and 25*b* applied to the upper surfaces of the ceramic green sheets 37 and 38 stacked in the upper portion.

Similarly, the line electrode materials 23*a*, 23*b*, 25*a* and 25*b* applied to the upper surfaces of the ceramic green sheets 37 and 38 in the upper portion are applied so as to be in the same position relation as that of the above described line electrode materials 24*a*, 24*b*, 26*a* and 26*b*. In addition, regions 45 and 46 and 47 and 48 represented by imaginary lines on the upper surfaces of the ceramic green sheets 37 and 38 indicate positions respectively overlapped with the line electrode materials 24*a* and 24*b* and 26*a* and 26*b* in the lower portion.

Thus, as can be analogized from FIG. 4, in a stacked state, the line electrode materials 24*a* and 24*b* arranged in the lower portion are positioned in the center of the line electrode materials 23*a* and 23*b* and the line electrode materials 25*a* and 25*b* arranged in the upper portion. Accordingly, the inductor 21 according to the present embodiment is adapted such that the line electrodes 23*a* and 23*b* and 25*a* and 25*b* respectively constituting first and third inductor elements are arranged in a first position of the heights in the sintered body and the line electrodes 24*a* and 24*b* and 26*a* and 26*b* respectively constituting second and fourth inductor elements are arranged in a second position of the heights therein.

Furthermore, according to the present embodiment, the ceramic green sheets 35 and 36 having no electrode materials applied thereto are inserted between the ceramic green sheets 34 and 37. Thus, it is found that the distance between the adjacent line electrodes, for example, between the line electrodes 23*b* and 24*a* is further increased by insertion of the ceramic green sheets 35 and 36. It should be noted that in the present invention, ceramic green sheets for insertion such as the ceramic green sheets 35 and 36 need not be necessarily inserted.

Additionally, although the inductor 21 is adapted such that the line electrodes constituting the inductor elements include the plurality of line electrodes 23*a* and 23*b* to 26 and 26 respectively overlapped with each other through ceramics layers, only one line electrode may constitute a single inductor element. In addition, inductor elements respectively comprising different numbers of line electrodes may be arranged side by side in a direction perpendicularly intersecting such a direction as to connect the first and second side surfaces 22*a* and 22*b*. More specifically, an arbitrary number of line electrodes may constitute each of the inductor elements.

In addition, the ceramic green sheets 31, 32, 39 and 40 for coating shown in FIG. 4 may be omitted depending on the conditions required for the inductor 21. Similarly, the number of ceramic green sheets to be stacked can be suitably changed according to the usage.

Furthermore, although in the above described embodiment, the sintered body 22 formed of the magnetic material is used, an insulating ceramic sintered body obtained by stacking ceramic green sheets mainly composed of insulating ceramics to cofire the same may be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An inductor comprising:

a sintered body obtained by stacking a plurality of ceramic green sheets of cofire the same, a plurality of line electrodes arranged so as to extend between first and second side surfaces of the sintered body and arranged side by side in a direction perpendicularly intersecting such a direction as to connect the first and second side surfaces thereof in said sintered body, and a plurality of outer electrodes respectively formed on the first and second side surfaces of said sintered body so as to be electrically connected to both ends of said line electrodes, said inductor having a structure in which a plurality of inductor elements formed between the plurality of outer electrodes formed on the first side surface of the sintered body and the plurality of outer electrodes formed on the second side surface thereof are arranged side by side in the direction perpendicularly intersecting the direction to connect the first and second side surfaces, characterized in that the line electrodes constituting the adjacent inductor elements are formed of line electrode materials applied to said different ceramic green sheets such that the line electrodes constituting the inductor elements adjacent to each other in the direction perpendicularly intersecting the direction to connect the first and second side surfaces of said sintered body are not positioned in the same plane.

2. The inductor according to claim 1, wherein the ceramic green sheet having the line electrode materials forming the line electrodes constituting one of said adjacent inductor elements applied thereto and the ceramic green sheet having the line electrode materials forming the line electrodes constituting the other inductor element applied thereto are stacked with the ceramic green sheets having no line electrode materials applied thereto being interposed therebetween, so that the line electrodes constituting said adjacent inductor elements are arranged so as not to be positioned in the same plane.

3. The inductor according to claim 1, wherein at least one of said plurality of inductor elements comprises a plurality of line electrodes overlapped with each other through ceramics layers in the direction of the thickness of the sintered body.

4. The inductor according to claim 1, wherein the line electrodes constituting said plurality of inductor elements are alternately formed in a first position of the heights and a second position of the heights in the sintered body in the direction perpendicularly intersecting the direction to connect the first and second side surfaces of said sintered body.

5. The inductor according to claim 4, wherein one of the ceramic green sheets having a plurality of line electrodes formed thereon with predetemined spacing and the other ceramic green sheet having line electrodes formed thereon with the same spacing as said predetermined spacing are stacked such that each of the line electrodes on said one ceramic green sheet is positioned in the center of the line electrodes on the other ceramic green sheet, so that the plurality of line electrodes are alternately formed in the first position of the heights and the second position of the heights in the sintered body in the direction perpendicularly intersecting the direction to connect the first and second side surfaces of said sintered body.

6. The inductor according to claim 1, wherein said sintered body is formed of a magnetic material.

7. The inductor according to claim 1, wherein said sintered body is formed of an insulating material.

* * * * *